US005711769A

United States Patent [19]

Rinker et al.

[11] Patent Number: 5,711,769

[45] Date of Patent: Jan. 27, 1998

[54] PROCESS FOR PASSIVATION OF REACTIVE COAL CHAR

[75] Inventors: Franklin George Rinker, Perrysburg; Deane Avent Horne, Toledo, both of Ohio; Dennis Wayne Coolidge, Gillette, Wyo.; Ernest Peter Esztergar, La Jolla, Calif.

[73] Assignee: Tek-Kol Partnership, La Jolla, Calif.

[21] Appl. No.: 525,235

[22] Filed: Sep. 8, 1995

[51] Int. Cl.[6] ..... C10L 5/00; C10B 21/18

[52] U.S. Cl. ..... 44/620; 44/626; 201/28; 201/29; 201/39

[58] Field of Search ..... 44/620, 626, 591, 44/607; 201/28, 29, 39

[56] References Cited

U.S. PATENT DOCUMENTS

| | | | |
|---|---|---|---|
| 2,793,109 | 5/1957 | Huebler et al. | 75/3 |
| 3,013,951 | 12/1961 | Mansfield | 202/15 |
| 3,302,936 | 2/1967 | Ban | 263/28 |
| 3,672,069 | 6/1972 | Reh et al. | 34/20 |
| 4,104,129 | 8/1978 | Fields | 201/17 |
| 4,269,593 | 5/1981 | Faulkner et al. | 432/58 |
| 4,396,394 | 8/1983 | Li et al. | 44/626 |
| 4,401,436 | 8/1983 | Bonnecaze | 44/1 |
| 4,402,706 | 9/1983 | Wunderlich | 34/12 |
| 4,511,363 | 4/1985 | Nakamura et al. | 44/626 |
| 4,521,278 | 6/1985 | Kelley et al. | 201/17 |
| 4,523,927 | 6/1985 | Kuge et al. | 44/626 |
| 4,741,837 | 5/1988 | Schweizer et al. | 44/620 |
| 4,769,042 | 9/1988 | Ito et al. | 44/626 |
| 4,797,136 | 1/1989 | Siddoway et al. | 44/620 |
| 4,828,575 | 5/1989 | Bellow, Jr. | 44/626 |
| 4,834,650 | 5/1989 | Docherty et al. | 432/235 |
| 4,924,785 | 5/1990 | Schultz et al. | 110/346 |
| 5,087,269 | 2/1992 | Cha et al. | 44/626 |
| 5,322,530 | 6/1994 | Merriam et al. | 44/620 |
| 5,547,548 | 8/1996 | Siddoway et al. | 44/620 |

*Primary Examiner*—Margaret Medley
*Attorney, Agent, or Firm*—Brinks Hofer Gilson & Lione

[57] ABSTRACT

A continuous process for treating coal to form stable coal char by passivating the coal and then rehydrating and cooling the product thereof to prevent spontaneous ignition. The process includes the steps of pyrolyzing the coal to vaporize and remove low end volatile materials and to mobilize high end volatile materials and cooling to demobilize the high end volatile materials within the at least partially collapsed micropores of the coal char to pyrolytically passivate the coal char and form a char having about 14–22 wt % high end volatiles. The pyrolytically passivated coal char is then conveyed to a reaction vessel wherein a process gas having about 3%–21% by volume oxygen flows through the reaction vessel to at least partially fluidize the coal char and oxidatively passivate the coal by chemisorption of oxygen. The passivated coal char is then substantially simultaneously rehydrated and cooled to form a stable coal char having about 5–10 wt % moisture.

17 Claims, 3 Drawing Sheets

PROCESS FOR PASSIVATION OF REACTIVE COAL CHAR

FIELD OF THE INVENTION

This invention relates to a process for the passivation of reactive coal char. More particularly, this invention relates to a process for the favorable passivation and rehydration of reactive coal char.

BACKGROUND OF THE INVENTION

The most abundant coal resources in western North America are low rank coals, including subbituminous and lignite. Many deposits of the low rank coals are relatively inexpensively mined compared to higher-rank coals in eastern North America, Australia and Europe, but their economic value is significantly reduced because they contain significant amounts of moisture and oxygen in combined form. Moisture contained within the coal results in both increased transportation costs from the coal deposit to the point of use, and decreased heat available from the coal when burned because of the heat required to evaporate the moisture. The problem generally exists in all subbituminous coals and is particularly acute with low-rank coals, which may contain from 20% to 50% moisture when mined.

A well known practice to reduce the moisture content in coal is to evaporate the moisture by low temperature heating of the coal to about 80°–150° C. The low temperature heating method, however, is disadvantageous because the resultant dried coal has a propensity for self heating and also readily reabsorbs moisture from the atmosphere to approach its previous moisture content state. Self-heating, also referred to as "autogenous" heating or pyrophoricity, is the tendency of a material to spontaneously ignite and burn upon exposure to air at ambient conditions. This self heating is related to two processes, the heat of rehydration of the dried coal or coal char and the chemisorption of oxygen.

Mild gasification methods, used in producing process derived fuel, also typically dry the coal before gasification to form coal char. The coal is dried by thermal processing using continuously flowing heated streams of oxygen-deficient gas for convective heat transfer to the coal. Similar to dried coal, it is well known that coal char has a propensity to self-heat when stored and shipped at atmospheric ambient conditions or when exposed to water in liquid or vapor form.

When exposed to the atmosphere, dry coal char rapidly adsorbs water vapor and oxygen and subsequently heats up and it ignites if not cooled. The adsorption of water vapor or oxygen and resultant oxidation of the coal char is manifested in an exothermic reaction. Oxygen physically adsorbs onto the surface of the coal and chemically reacts with organic molecules within the coal. This reaction can have an ultimate heat release of about 120,000 kJ per mole of oxygen. Because oxidation rates will approximately double with each 10° C. rise in temperature, the heat, if not dissipated, will promote a self-accelerating oxidation process and cause the coal temperature to rise progressively until the coal spontaneously ignites. If self-heating of the coal char reaches ignition temperature it is commonly referred to as "spontaneous combustion," which represents a serious hazard whenever substantial amounts of coal char are stockpiled or transported.

Another cause of self-heating occurs when coal char adsorbs water, either in liquid or vapor form. At ambient temperatures, carbon oxidation rates are generally too small to initiate the combustion of coal char. However, when dry coal or coal char is wetted by water, heat is released due to the adsorption of water onto the dry coal or coal char. Water vapor physically adsorbs onto the coal or coal char releasing the heat of vaporization which amounts to about 20,000 kJ/mole of water. Such "heat of wetting" raises the temperature of the dry coal or coal char to levels at which carbon oxidation occurs more rapidly. The increased oxidation rates eventually lead to spontaneous combustion. This mechanism explains why spontaneous combustion of coal commonly occurs after rain following a period of dry hot weather. The foregoing mechanism also takes effect when dry coal or coal char is placed on wet ground, and when wet coal is loaded onto an established, partially dried-out stockpile. In the latter cases, heating invariably begins at the interface between the wet and dry material.

Equilibrium moisture is defined by ASTM as the moisture content of a sample of coal or coal char when it is equilibrium with 96% relative humidity air at 30° C. It is believed that this condition is similar to that found in a stockpile of moist coal. If a stockpile of coal is above its equilibrium moisture level then it will tend to lose moisture to its surroundings, on the other hand, if it is below its equilibrium moisture level then it will tend to pick-up moisture from its surroundings.

Equilibrium moisture plays an important role in the self-heating of coal or coal char stock piles. If the coal or coal char are below their equilibrium moisture then a stockpile will tend to pick-up moisture, causing the stockpile to heat up due to the heat of rehydration. The rise in temperature will cause the rate of oxygen chemisorption to increase which will in turn cause the effected part of the stockpile to heat and to eventually self-ignite. Simply, drying low rank coals does not change the equilibrium moisture level, therefore the dried coal will tend to rehydrate back to its equilibrium moisture level releasing the heat of rehydration.

In view of the propensity of coal char to self-heat, it is desirable that all of the coal char in a stockpile is suitably treated to passivate the self heating character of the coal char thereby protecting the remainder of the pile from spontaneous combustion.

It is an object of the present invention to provide a process and apparatus for passivation of fresh coal char. It is a further object of the present invention to remove a portion of the lower volatile components of the coal char for use as a process derived fuel, and in addition, controllably and rapidly quench the coal char to at least partially collapse and seal the micropores and interstices of the of the coal char with previously mobilized heavy coal tars that are demobilized by quenching thereby passivating the self heating character of the char to provide a coal char having suitable storage stability while retaining desirable fuel characteristics. It is a further object of the present invention to provide an apparatus and process for recycling process gas to control the partial pressure of oxygen favorable to the passivation of reactive coal char. Another object of the present invention is to provide an apparatus and process to treat dried reactive coal char with a partially inert process gas mixture by a recirculation system to facilitate the process of chemisorption which prevents the char from absorbing and/or adsorbing further amounts of oxygen sufficient for spontaneous combustion when stockpiled. As used herein the term "low end volatile components" refers to those compounds which are vaporized from about 400°–480° C. Similarly, the term "high end volatile components" refers to those compounds which are vaporized from about 480°–950° C.

SUMMARY OF THE INVENTION

Briefly, according to the invention there is provided a continuous process for treating coal to form stable coal char by passivating the coal and then rehydrating and cooling the product thereof to prevent spontaneous ignition. The process includes the steps of 1) pyrolyzing the coal by progressively heating substantially all of the coal to a temperature sufficient to vaporize and remove low end volatile materials from the coal to form coal char and sufficient to mobilize some of the high end volatile materials within the char. The combined effect of volatile removal and mobilization is to at least partially collapse micropores within the char; 2) cooling the coal char to a temperature sufficient to demobilize and deposit volatile materials within the at least partially collapsed micropores of the coal char to pyrolytically passivate the coal char and form a char having about 14–22 wt % volatiles composed of mostly high end volatiles; 3) conveying the char of step b) to a reaction vessel wherein a process gas having about 3%–21% by volume oxygen flows through the reaction vessel to at least partially fluidize the coal char and oxidatively passivate the coal by chemisorption of oxygen; and 4) substantially simultaneously rehydrating and cooling the passivated coal char to form a stable coal char having about 5–10 wt % moisture, preferably 8 wt % moisture.

BRIEF DESCRIPTION OF THE DRAWINGS

Further features and other objects of this invention will become clear from the following detailed description made with reference to the drawings in which.

DETAILED DESCRIPTION OF THE PREFERRED EMBODIMENTS

Figure 1:
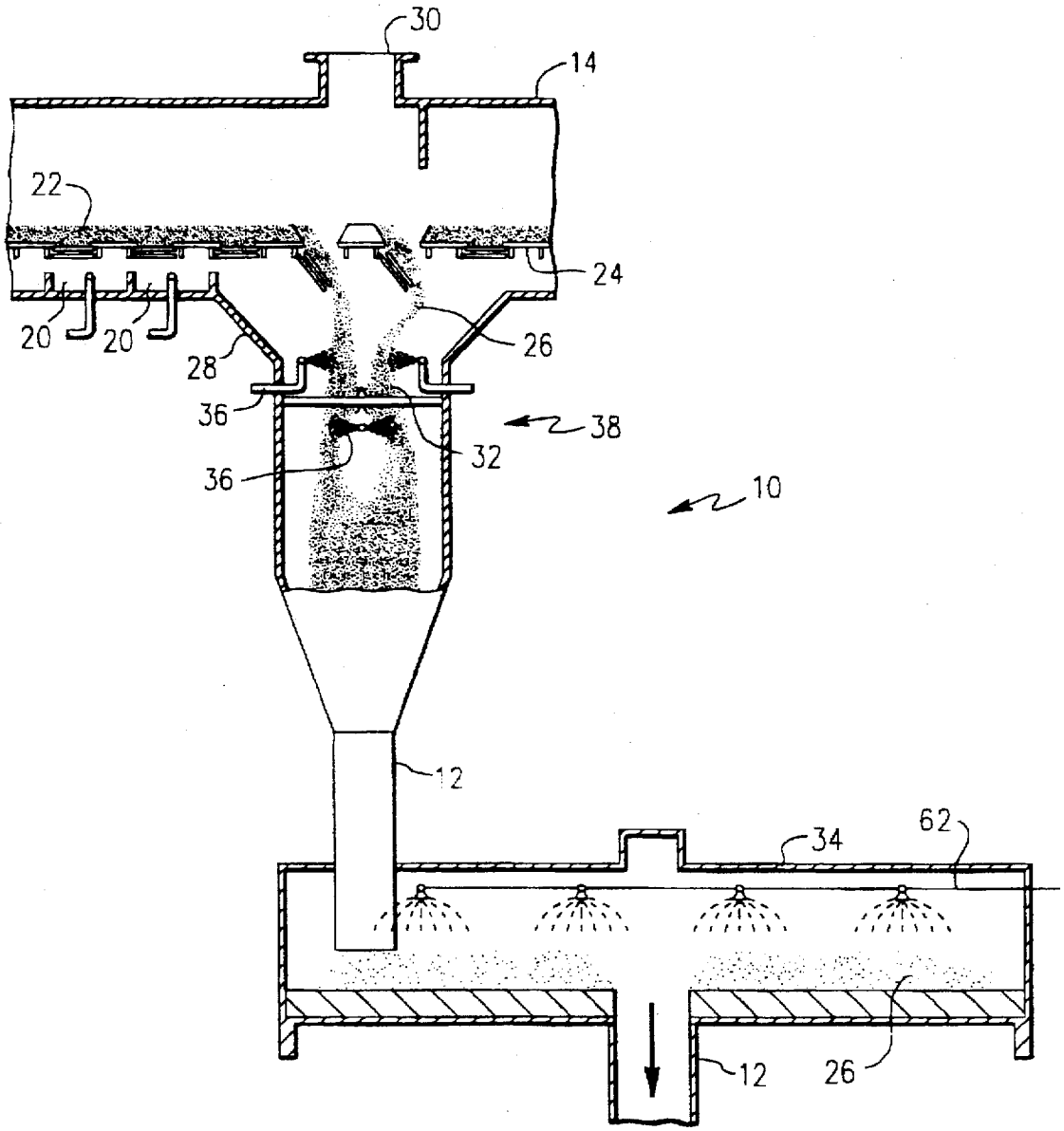
FIG. 1 is a schematic of the process of the present invention illustrating pyrolitic passivation and oxidative passivation.

Referring to the drawings wherein like reference characters represent like elements, there is shown an apparatus 10 for the favorable passivation and rehydration of reactive coal char. For purposes of clarity certain details of constreaction are not provided in view of such details being conventional and well within the skill of the art once the invention is disclosed and explained. For example, in the description of the figures reference will be made generally to a conduit 12 and the like rather than attempting to distinguish between conduits required for the handling of the flow of process gas or coal char. Reference is made to CHEMICAL ENGINEERS' HANDBOOK, 5th Edition, McGraw Hill, New York, 1973 and to the material handling industry literature generally for detailed descriptions of the various apparatus and processing structures and conditions.

Referring to the figures, a schematic depiction of an apparatus 10 suitable for carrying out the process of this invention is shown. The apparatus 10 includes a pyrolyzer 14 for pyrolytic passivation, a reaction vessel 16 for oxidative passivation and a rehydrator/cooler 18 for substantially simultaneously rehydrating and cooling of the coal char.

The pyrolyzer 14 may be a batch type furnace or a continuous type furnace of a type well known in the art. For a more detailed discussion of the various designs of pyrolyzer furnaces, e.g., a sliding grate furnace, circular grate furnace, roller grate furnace and linear grate furnace reference is made to U.S. Pat. Nos. 4,521,278; 3,302,936; 4,269,593; and 3,013,951, respectively, incorporated herein by reference. In addition, for a more detailed discussion of other types and designs of pyrolyzer furnaces, reference is made to U.S. Pat. Nos. 4,834,650 and 4,924,785, also incorporated herein by reference.

Each pyrolyzer 14 has a refractory lined wall, a roof and a floor as known in the art. The pyrolyzer 14 is divided into a series of separate heating zones 20 to sequentially and progressively raise the temperature of coal 22 to remove low end volatile materials and then heat the coal to a desired maximum temperature to mobilize some of the high end volatile materials. The separate heating zones 20 minimize the problems associated with coal bed temperature variations and uncontrolled vaporization of volatiles within the coal 22.

Positioned intermediate the roof and floor within the pyrolyzer 14 is a grate 24. The grate 24 supports the coal 22 and allows heated streams of oxygen-deficient gas of varying controlled temperature to rise up from beneath for convective heat transfer to the coal bed to progressively heat the coal bed within the separate zones 20 and pyrolyze the coal to form coal char 26. The grate 24 is operatively connected to a conduit 12 that has a metal lining 28 and a refractory backing of a material well known in the art. The metal lining 28 may be conical shaped to funnel the char for further processing.

The pyrolyzer 14 is preferably equipped with suitable seals (not shown) making the pyrolyzer gas tight, which allows control of the atmosphere during the pyrolytic passivation process such that the process can be performed at or close to atmospheric pressure. Exhaust gases which are produced from the pyrolysis process are withdrawn from the pyrolyzer through a flue 30.

Coal 22 is loaded onto the grate 24 and then sequentially advanced through the pyrolyzer 14. Streams of oxygen-deficient gas, of progressively increasing temperature, are introduced into each heating zone 20 through a manifold by means of one or more intakes and pass through the grate to sequentially and progressively heat the coal. The coal 22 typically enters the pyrolyzer at temperatures of about 149°–204° C. The coal is then progressively heated within the zones to temperatures of about 427°–537° C. As the grates 24 advance, the coal 22 is heated to a progressively higher temperature to vaporize and remove low end volatiles and then heated to achieve a desired mild gasification temperature after which the char moves from the pyrolyzer toward a port for discharge through the conduit 12.

The falling pyrolyzed coal char 26 may be dispersed by a deflector 32. As shown in the figures, the deflector 32 is an inverted cone shaped member having a first end attached to the top of the conduit 12. The deflector slopes in a downward direction toward the center of the conduit to direct coal char from the grate 24 into a quench chamber 34. The deflector 32 may be adjusted transversely to match the trajectory of the flowing coal char stream. As the grate 24 advances, char 26 exists the pyrolyzer 14 and falls by the force of gravity onto the deflector 32. The deflector 32 preferably comprises a non-abrasive material which is inert to the conditions present within and proximate to the pyrolyzer 14. The deflector 32 reduces the effective horizontal cross-sectional area of the conduit 12. By reducing the effective diameter of the conduit 12 and dispersing the falling char 26 in a 360 degree pattern the deflector increases the effective coal char surface area exposed to a coolant spray. Two or more deflectors 32 may be positioned along the vertical centerline of the conduit 12 to spread the falling char into multiple streams thereby allowing strategically positioned coolant nozzles 36 to cool the char.

The coal 22 is sequentially heated to a progressively higher temperature by streams of oxygen-deficient gas to ensure that the char obtains the desired temperature throughout the cross-section of the char bed such that low end volatile materials are first vaporized and then removed from the coal and then heated to mobilize some of the high end volatile materials within the char to at least partially collapse the micropores within the char to form a char having about 14–22 wt % residual volatiles and a reduced equilibrium moisture content from about 20–30 wt % to about 5–10 wt % and to prevent self-heating of the char. It is believed that improper heating conditions will result in temperature variations through a cross-section of the char bed thereby allowing for excessive variation in the volatile content of the char such that desirable low end volatiles within portions of the char may either not be vaporized thereby preventing production of all of the desirable volatile byproduct for subsequent use and impeding one economic advantage of the present invention, or may overheat the vapors, thereby preventing pyrolyric passivation of the char.

The formed coal char 26 is passivated and stabilized by a pyrolytic passivator 38. The pyrloytic passivator 38 is preferably positioned substantially along the centerline of the pyrolyzer 14 for optimum effect after heating of the char to a desired temperature. The pyrolytic passivator 38 includes a plurality of coolant spray nozzles 36 and supply lines positioned at various locations within and around conduit 12 so that hot coal char 26 is sprayed with coolant as it exits the grate 24 and falls under the force of gravity into the conduit 12. It will be appreciated that to efficiently stabilize coal char 26 against autogenous heating, it is critical that the pyrolytic passivator rapidly quench all of the hot coal char particles after they have obtained the desired temperature required to mobilize some of the high end volatile materials, thereby reducing the coal char temperature by 100° C. in a few minutes. The pyrolytic passivator quenches the char 26 with coolant in about 20 minutes or less, preferably about 10 minutes or less, and most preferably about 2 minutes or less. In accordance with the most preferred embodiment, the number of nozzles 36, temperature of coolant, supply rate of coolant and the like may be varied as required to obtain a cooling rate of about 50° C. per minute to at least partially collapse the micropores within the char to form a char having about 14–22 wt % high end volatiles. Hot coal char 26 particles which exit the pyrolyzer are rapidly quenched by the pyrolytic passivator without the detrimental effects of over-cooling. Utilizing a water coolant, the present invention achieves this by providing a uniform contacting of about 2.2 kg. of water to 44.1 kg. of hot coal char as the char exits the pyrolyzer. The coolant in the supply line should be maintained at 15°–35° C., and preferably 15° C., to reduce the temperature of the char by 100° C. in about 2 minutes at the delivery chute to a desirable output range of about 399°–454° C. and preferably, about 427° C.

The pyroltyic passivator may use 2 sets of nozzles 36 to spray coolant. In cases where the coolant is water, wetting of char is accomplished using both direct and indirect contact of water spray with char. Indirect contact of water to char is provided by the deflector 32 which is incidentally wetted by the spray nozzles 36. Direct contact of water to char 26 is provided by both sets of spray nozzles 36. The spray nozzles 36 are well known in the art and are commercially available from a number of manufacturers. For example, commercially available nozzles 36 are the WhirlJet® and FullJet® nozzles (type AASSTC, type 104, and type G) available from Spraying Systems, Inc., located in Wheaton, Ill.

The coolant which is sprayed may be a liquid such as water or an oxygen-deficient gas such as nitrogen or a combination thereof. In addition, the coolant spray apparatus may have a plurality of spray nozzles 36 which effectively atomizes the liquid coolant spray produced by the spray nozzles thereby increasing the coolant coverage of the char 26.

By strategically positioning the plurality of nozzles 36, the present invention effectively increases the coal char surface area which is exposed to coolant during pyrolyric passivation. Moreover, by effectively increasing the coal char surface area exposed to coolant as described herein, the present invention rapidly quenches substantially all of the coal char as it leaves the pyrolyzer from a maximum desired temperature so as to permit low end volatiles to pass from the char yet freeze the high end volatiles within micropores of the coal char thereby preventing autogenous ignition of the char by preventing the entry of water, oxygen and the like into the micropores.

The pyrolytically passivated coal char 26 is then discharged into a quench chamber 34 of a type well known in the art wherein the coal char is further cooled with water from a water spray apparatus 62 of a type well known in the art. The cooled coal char particles may range in size from about 44–50,800 μm or more. The cooled coal char 26 is metered from the quench chamber 34 into a reaction vessel 16 through a rotary valve 42. The rotary valve 42 serves as an airlock to facilitate containment of the atmosphere within the reaction vessel 16 and also acts to exclude moisture from the quench chamber 34 from entering the reaction vessel.

The reaction vessel 16 is shown as a fluidized bed such as a vibrating fluidized bed. However, it will be appreciated that most any type of bed or sealed vessel for handling and conveying solid particles and contacting the solid particles with a process gas in a cross flow system that is isolated from the surrounding ambient air may be used. In a preferred embodiment, the reaction vessel 16 is a vibrating fluidized bed in which fluidization is maintained by a combination of pneumatic and mechanical forces. A process gas 44 is introduced into the reaction vessel 16 through a plenum positioned beneath a conveying deck within the bed through ducts and the like. The process gas 44 passes from the plenum up through perforations or openings within the conveying deck, through the bed of coal char 26 and into an exhaust hood 46. The fluidization of the coal char 26 results from the upward flow of the process gas 44 at a velocity sufficiently high to buoy the char particles and over-come the influence of gravity. The process gas 44 velocity may be adjusted as desired to at least partially fluidize and provide sufficient contact between the char particles 26 and the process gas. The vibrating action of the bed acts to assist in mixing and conveying the relatively larger coal char particles along the bed and preventing agglomeration of the smaller char particles.

In a preferred embodiment, the coal char 26 enters the reaction vessel at a temperature of about 150°–200° C., preferably about 160° C. The reaction vessel 16 is separated into multiple zones wherein the coal char 26 comes into contact with the process gas 44, each zone has a controlled entering temperature as well as a limited and controlled oxygen concentration. Because the composition of the process gas 44 within the reaction vessel 16 must be controlled the entering and exiting coal char 26 must pass through a rotary valve 42 to prevent ambient air from entering the reaction vessel. The solid char particles 26 undergo intensive intermixing as the process gas 44 surrounds each particle transferring heat directly and facilitating an oxidative chemical reaction between the process gas and the coal char particles.

As the process gas 44 enters the reaction vessel and passes up through the bed of the reaction vessel the char particles are partially fluidized and a portion of the oxygen in the process gas reacts with the char 26 thereby releasing heat. The heat that is released in the bed is removed from the reaction vessel by the continuous upward flow of the process gas through the bed. A portion of the oxygen that reacts with the char 26 chemisorbs to the char and stabilizes the char thereby restraining the char from spontaneously igniting. As used herein the term "chemisorbed" refers to the formation of a bond between a surface carbon atom or a carbon atom in a partially collapsed pore of the coal char and an oxygen atom in contact with the coal char. After the coal char 26 is retained for a controlled predetermined retention time in the reaction vessel 16, the passivated coal char is continuously discharged over a weir plate 48. The coal char 26 is discharged over the weir plate 48 and through a rotary valve 42 at the end of the reaction vessel 16 at a temperature of about 175°–200° C., preferably about 182° C.

The remaining portion of oxygen within the process gas 44 that reacts with the coal char 26 reacts to form carbon dioxide and carbon monoxide and is discharged with the process gas from the reaction vessel 16. It will be appreciated that the amount of oxygen chemisorbed to the coal char 26 depends on the temperature, contact time with coal char and initial oxygen concentration of the process gas 44.

In a preferred embodiment, the process gas 44 enters the reaction vessel 16 at a temperature of about 154°–188° C., preferably about 157° C., containing about 3%–21% volume oxygen. The volume percent of oxygen of the process gas 44 is inversely proportional to the temperature of the process gas. As the temperature of the process gas decreases the volume percent of oxygen is increased. At a temperature of 188° C. the process gas 44 contains about 3% by volume oxygen and at a temperature of about 82° C. the process gas contains about 21% by volume oxygen. It will be appreciated that as the temperature of the process gas 44 is reduced, the volume percent of the oxygen may be increased. The properties of the process gas 44 must be controlled to balance the energy release rate with the energy absorption rate. This balance of energy exchange deters an uncontrolled reaction in the reaction vessel which may lead to combustion. This energy exchange is referred to as "energy compensation" by those familiar with the art. An example of the composition of the process gas entering the reaction vessel 16 is provided in Table 1.

TABLE 1

| Gas Stream | Volume percent |
|---|---|
| CO | 0.4 |
| $CO_2$ | 5.6 |
| $O_2$ | 4.0 |
| $N_2$ | 90.0 |

The process gas 44 passes up through the reaction vessel 16 thereby partially fluidizing the coal char 26. A portion of the oxygen in the process gas 44 reacts with the coal char 26 thereby releasing heat and raising the discharge process gas temperature to about 182° C. A portion of the oxygen in the process gas 44 reacts with the coal char 26 and chemisorbs to the coal char thereby stabilizing the coal char with respect to its tendency to spontaneously ignite. The remaining portion of oxygen within the process gas 44 that does not chemisorb reacts with the coal char 26 to form carbon dioxide and carbon monoxide and is subsequently discharged with the exiting process gas. The oxygen concentration of the process gas 44 exiting the reaction vessel 16 after reacting with the coal char 26 in the reaction vessel is about 2.6%–6.6% by volume, preferably about 2.6%. An example of the composition of the process gas 44 exiting the reaction vessel 16 is provided in Table 2.

TABLE 2

| Gas Stream | Volume percent |
|---|---|
| CO | 0.8 |
| $CO_2$ | 6.6 |
| $O_2$ | 2.6 |
| $N_2$ | 90.0 |

The process gas 44 is then discharged from the reaction vessel 16. It will be appreciated that about 5 wt %–10 wt %, preferably about 5 wt %, of the coal char 26 is entrained within the discharged process gas 44 because the reaction vessel 16 contains a portion of coal char of a fine particle size. Accordingly, to remove the coal char 26 particles from the process gas 44 the discharged process gas is passed through a conduit 12 to a dust collector 50. The dust collector 50 includes a chamber through which the process gas 44 passes to permit deposition of solid particles for collection. The dust collector 50 may be of most any suitable type well known in the art such as a cyclone separator.

Figure 2:
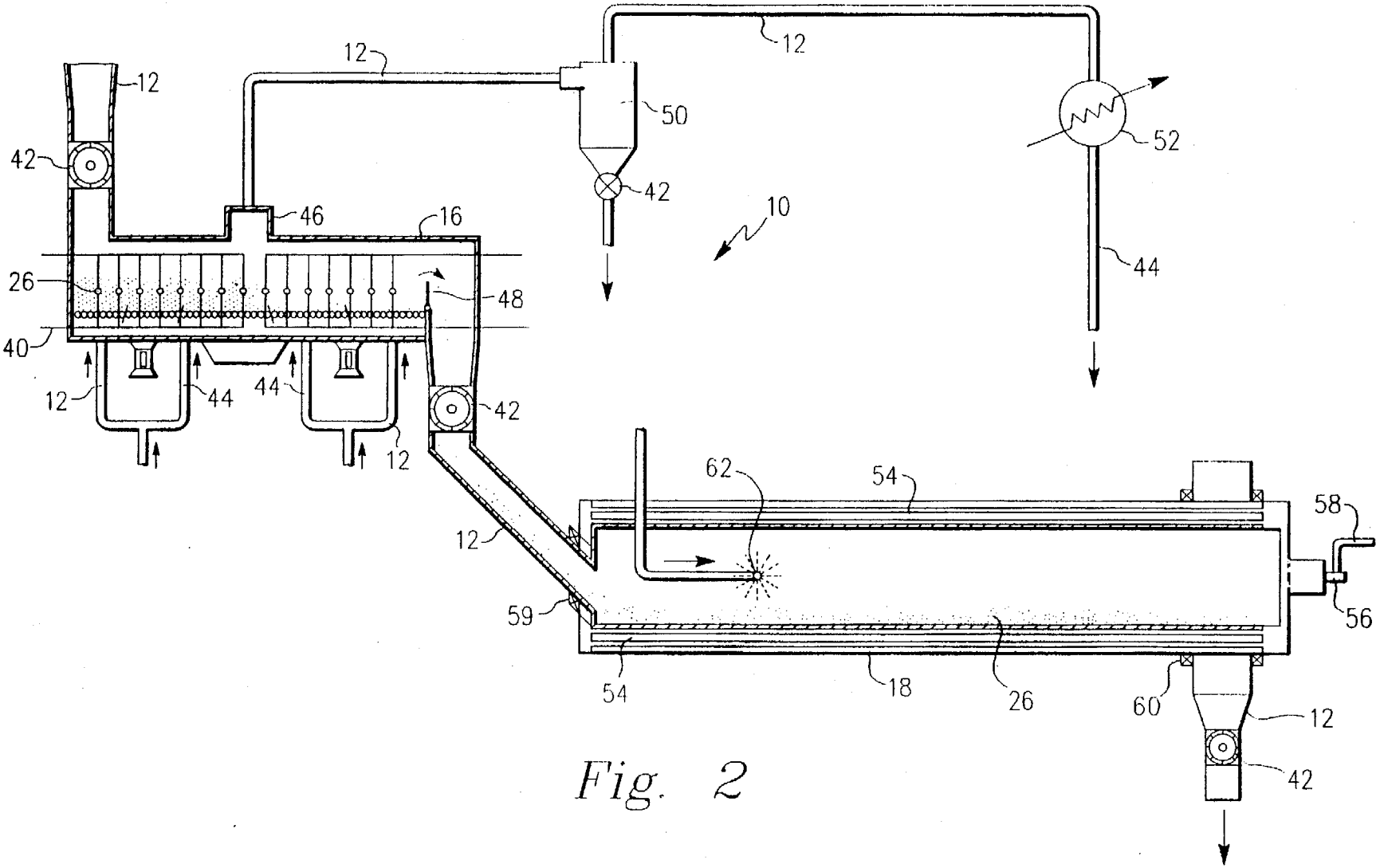
FIG. 2 is a schematic of the process of the present invention illustrating rehydration and cooling of the coal char.

To control the passivation reaction temperature within the reaction vessel 16, in one embodiment the process gas 44, containing some uncollected coal char 26 particles, exits the dust collector 50 and is cooled indirectly in a heat exchanger 52. The heat exchanger 52 may be either an air cooled or liquid cooled heat exchanger positioned externally of the reaction vessel 16. The temperature of the process gas 44 downstream of the reaction vessel 16 is monitored and the quantity of cooling air supplied to the heat exchanger 52 is controlled thereby controlling the temperature of the process gas leaving the heat exchanger. In an alternative embodiment as shown in FIG. 2 for illustrative purposes, the passivation reaction temperature may be controlled by transfer of heat within the reaction vessel 16 to cooling tubes 40 positioned within the coal char 26. The cooling fluid passes through the cooling tubes and is recirculated in a closed loop through an external shell and tube heat exchanger as well known in the art for transfer of heat to a secondary cooling fluid.

As previously described, the temperature of the process gas 44 exiting the reaction vessel 16 is monitored and the flow of cooling fluid controlled to maintain a desired passivation reaction temperature within the reaction vessel. For a reaction proceeding within a narrow temperature range of about 100°–200° C. it is advantageous to avoid boiling water heat transfer. Moreover, it is advantageous to avoid cold spots which may result in untreated reactive coal char 26 leaving the reaction vessel 16. Accordingly, the cooling fluid may be a hot oil or heat transfer fluid capable of operating at or near the maximum char temperature of about 260° C.

The cooled process gas 44 is then monitored for oxygen content. If required, the oxygen content of the process gas 44 is replenished with a controlled amount of air to raise the oxygen content to about 3% to 21% by volume oxygen. After the oxygen level of the process gas 44 is raised, the process gas is recirculated back to the reaction vessel 16 and/or to the pyrolyzer 14 as desired. More particularly, depending upon the concentration of the renewed process gas 44, the replenished process gas containing particulates, carbon monoxide, carbon dioxide, nitrogen and oxygen passes through a blower to raise the pressure of the process gas 44 which is then combined with a primary fuel gas that feeds the pyrolyzer 14 as previously described.

The reaction vessel 16 may also include a nitrogen purge system as well known in the art. The reaction vessel 16 is purged with nitrogen so as to reduce the oxygen level within the bed to about 8% by volume or less before the fresh highly reactive coal char 26 is introduced to the reaction vessel.

Figure 4:
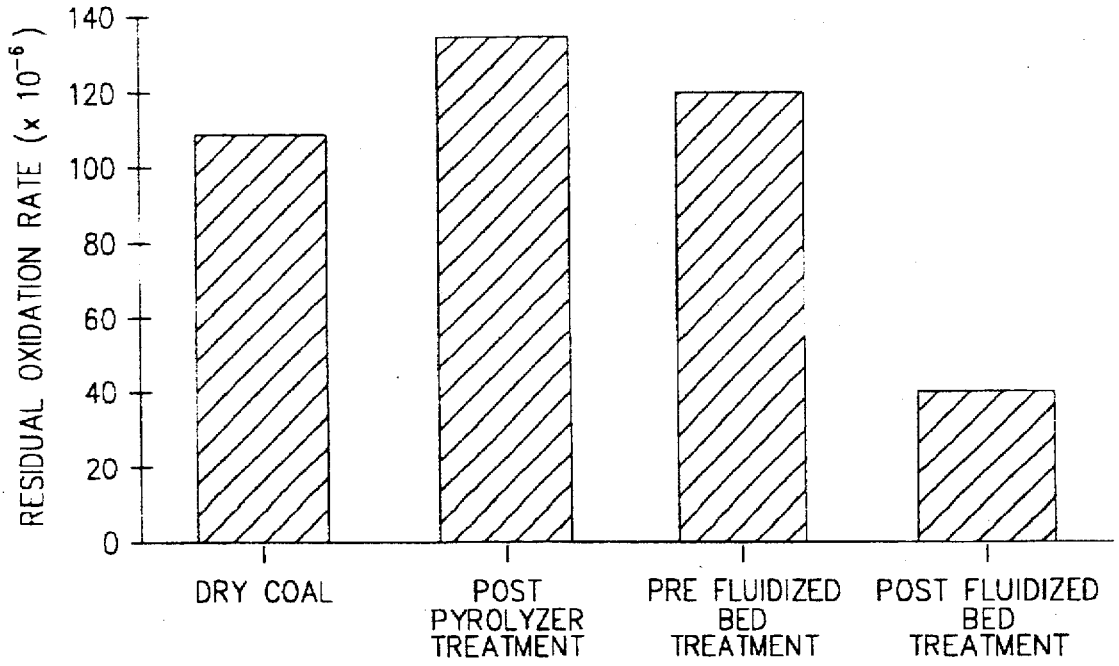
FIG. 4 is a bar graph of the residual oxidation rate of dry coal and coal processed at various stages in accordance with the present invention.

It will be appreciated that the degree of passivation of the coal char is related to the residual oxidation rate of the coal char. As shown below in FIG. 4, coal char has a substantial reduction in residual oxidation, i.e. is stabilized, after treatment in accordance with the present invention.

The residual oxidation rate was determined by placing a 150 gram sample of coal char in a stainless steel wire mesh basket. The basket was then placed in a retort, suspended from a balance capable of weighing to ±0.001 gram. The retort was then purged with dry, oxygen free nitrogen gas at a flow rate sufficient to exchange the retort volume four times per minute. While the nitrogen purge was occurring, the retort was heated 65.5° C. The sample weight was monitored to determine when the sample reached a constant weight. When constant weight was obtained, the nitrogen purge was replaced by a purge of dry air at the same flow rate. Oxygen from the air was chemisorbed in the coal char sample and caused a weight gain. The measured weight gain for a thirty minute period divided by the sample weight provided the residual oxidation rate in grams of oxygen per gram of char per minute.

Figure 3:
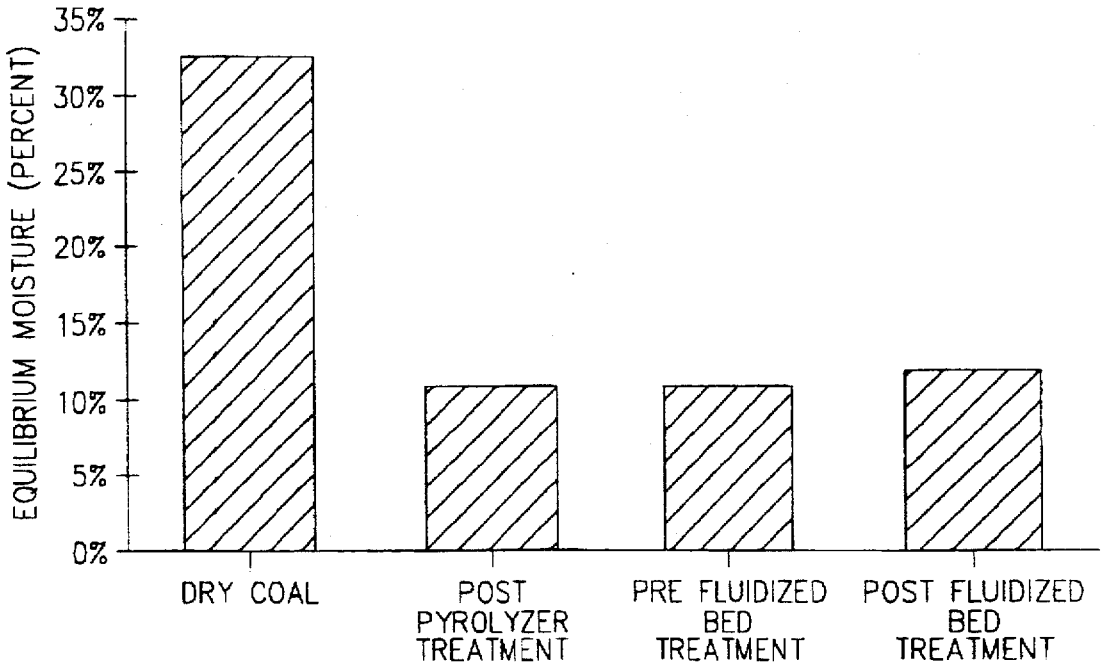
FIG. 3 is a bar graph of the equilibrium moisture volume percent of dry coal and coal processed at various stages in accordance with the present invention.

A comparison of the equilibrium moisture content of dry coal, before and after treatment in the pyrolyzer 18 and reaction vessel 16 is shown in FIG. 3. As shown in FIG. 3, the equilibrium moisture level of dry coal is about 32 wt % at about 90% relative humidity. After the coal has been treated in the pyrolyzer 18 and the reaction vessel 16 the equilibrium moisture level is about 10 wt % at about 90% relative humidity.

The oxidative passivated coal char 26 is then further processed by delivery to an energy compensated rehydration cooler 18. The rehydration cooler 18 concurrently cools and rehydrates the passivated coal char 26. The rehydration cooler 18 is a generally cylindrical vessel having a plurality of heat exchanger tubes 54 affixed to the circumferential walls of the cooler. The heat exchanger tubes 54 cool the cooler 18 to a desired to prevent unwanted condensation. The heat exchanger tubes preferably extend the length of the cooler 18 and are preferably comprised of an abrasion resistant material, e.g., stainless steel. The cooling fluid may include most any suitable coolant such as water and the like. Fresh cooling fluid enters the rehydration cooler 18 at inlet 56 while heated cooling fluid exits the exchanger tubes at outlet 58. The pyrolytic, oxidative passivated coal char 26 enters the rehydration cooler 18 through inlet 59 and cooled and rehydrated coal char 26 exits the cooler at outlet 60. The size and shape of the inlet 59 and outlet 60 may vary to allow coal char 26 to flow through the rehydration cooler 18 at a desired rate. The cooler 18 includes a water spray apparatus 62 positioned within the cooler to spray water along a centerline of the rotary cooler.

Preferably, the cooler 18 is inclined so that the inlet 59 of the cooler is raised above the outlet 60 end. Because the cooler 18 is so inclined, gravity operates to bias the flow of coal char 26 toward the outlet 60. In addition, the cooler 18 rotates along its longitudinal center at a predetermined rate to ensure the coal char 26 contacts the surface of the surrounding heat exchanger tubes.

The time that the coal char 26 is present in the cooler 18 is referred to as coal char retention time. The longer the coal char 26 is present in the cooler 18 the longer the char is exposed to the heat exchanger tubes and the cooler the char becomes. It is preferred to control the retention time to maximize char 26 cooling yet minimize rehydration processing time. In a preferred embodiment, the char retention time ranges from about 10–20 minutes. In addition to optimizing the char 26 retention time, the cooler 18 is also designed to increase the water to char contact time for rehydration. The velocity of the coal char 26 flow through the cooler 18 is controlled to about 1–2 feet/minute. The water spray apparatus 62 is positioned within the center of the rotary cooler 18 to maximize contacting of water spray with the coal char 26. Thus, the positioning of the water spray 62 allows the coal char 26 to be sprayed as it is stirred by the rotation of the cooler. The coal char 26 is rehydrated using both direct and indirect contact of water spray. The interior surface of the cooler 18, including heat exchanger tubes, are moistened by water sprayed from the water spray 62 thereby indirectly cooling the coal char 26 and directly cooling the char by the water spray apparatus.

It will be appreciated that when pyrolyzed coal char 26 is rehydrated an exothermic reaction is produced which produces heat energy. The rehydration process is self limiting in that as the coal char temperature rises due to rehydration the water adsorbed by the char 26 evaporates thus reducing the moisture content of the coal char. Therefore if the heat created by rehydration is not compensated for or removed from the coal char 26, the rate of rehydration and the probability of obtaining equilibrium moisture levels within the char making the char safe for transport is diminished. The increased coal char 26 temperatures caused by rehydration can result in non-uniform rehydration causing the formation of random hot spots on the coal char, which in turn can react with atmospheric oxygen to further the self heating effect. Therefore, to maximize the moisture levels of the coal char 26 during rehydration and to minimize processing time and formation of hot spots the coal char must be precisely cooled during rehydration.

The cooled and rehydrated coal char is cooled to about 38° C. and contains about 5–10 wt % moisture, preferably about 8 wt % moisture.

Having described presently preferred embodiments of the invention, it is to be understood that it may be otherwise embodied within the scope of the appended claims.

What is claimed is:

1. A continuous process for treating coal to form stable coal char by passivating the coal and then rehydrating and cooling the product thereof to prevent spontaneous ignition, the process comprising the steps of:

a) pyrolyzing the coal by progressively heating substantially all of the coal to a temperature sufficient to vaporize and remove low end volatile materials from the coal and heating to a mild gasification temperature to form coal char and sufficient to mobilize at least a portion of high end volatile materials within the char and at least partially collapse micropores within the char;

b) cooling the coal char to a temperature sufficient to demobilize the volatile materials within the at least partially collapsed micropores of the coal char and to pyrolytically passivate the coal char and form a char having about 14–22 wt % high end volatile;

c) conveying the char of step b) to a reaction vessel wherein a process gas having about 3%–21% by volume oxygen flows through the reaction vessel to at least partially fluidize the coal char and oxidatively passivate the coal by chemisorption of oxygen;

d) monitoring the temperature and oxygen content of the process gas exiting the reaction vessel;

e) progressively decreasing the temperature of the oxidative passivation within the reaction vessel from 200° to 100° C. in response to the monitored temperature of the process gas:

f) replenishing the oxygen content of the process gas flowing from the reaction vessel in response to the monitored oxygen content of the process gas;

g) reintroducing the replenished process gas to the reaction vessel; and h) substantially simultaneously rehydrating and cooling the passivated coal char to form a stable coal char having about 5–10 wt % moisture.

2. The process of claim 1 wherein the char has about 18–20 wt % volatiles.

3. The process of claim 2 wherein the coal is pyrolyzed to a temperature of about 537° C.

4. The process of claim 3 wherein the char of step b) is cooled in about 20 minutes or less.

5. The process of claim 3 wherein the char of step b) is cooled in about 5 minutes or less.

6. The process of claim 4 wherein the char of step b) is cooled by about 100° C.

7. The process of claim 3 wherein the char of step b) is cooled by continuously spraying about 2.2 kg of water on about 44.1 kg of char.

8. The process of claim 1 wherein the chemisorption of oxygen to the coal char raises the temperature of the process gas and lowers the oxygen content of the process gas.

9. The process of claim 1 wherein the temperature of the oxidative passivation is controlled by indirectly cooling the coal char within a reaction vessel.

10. The process of claim 8 wherein the reaction vessel is a vibrating fluidized bed.

11. The process of claim 10 wherein the coal char enters the vibrating fluidized bed at a temperature of about 150°–200° C. and is discharged from the vibrating fluidized bed as a temperature of about 175°–200° C.

12. The process of claim 8 wherein the oxygen concentration of the process gas exiting the vibrating fluidized bed is about 2.6%–6.6% by volume.

13. The process of claim 1 wherein the coal char of step d) is cooled to about 38° C.

14. The process of claim 1 wherein the coal char of step d) is cooled by heat exchanger tubes mounted circumferentially abrupt a cylindrical cooler, wherein the heat exchanger tubes agitate the coal char during rehydration thereby increasing the coal char surface area exposed to wetting.

15. The process of claim 14 wherein the cooler includes a water spray apparatus having at least one water spray nozzle for rehydrating the coal char as the coal char is conveyed through the cooler.

16. The process of claim 1 wherein the coal is oxidatively passivated by progressively decreasing the temperature of the coal as the volume percent of oxygen is progressively increased.

17. A continuous process for treating coal to form stable coal char by passivating the cast and then rehydrating and cooling the product thereof to prevent spontaneous ignition, the process comprising the steps of:

a) pyrolyzing the coal by progressively heating substantially all of the coal to a temperature of about 537° C. sufficient to vaporize and remove low end volatile materials from the coal and heating to a mild gasification temperature to form coal char and sufficient to mobilize at least a portion of high end volatile materials within the char and at least partially collapsed micropores within the char;

b) cooling the coal char by about 100° C. in about 20 minutes or less to demobilize the volatile materials within the at least partially collapsed micropores of the coal char and to pyrolytically passivate the coal char and form a char having about 14–22 wt % high end volatiles;

c) conveying the char of step b) to a reaction vessel wherein a process gas having about 3%–21% by volume oxygen flows through the reaction vessel to at least partially fluidize the coal char and oxidatively passivate the coal by chemisorption of oxygen, thereby raising the temperature of the process gas and lowering the oxygen content of the process gas;

d) monitoring the temperature and oxygen content of the process gas exiting the reaction vessel;

e) progressively decreasing the temperature of the oxydative passivation within the reaction vessel from 200° C. to 100° C. in response to the temperature of the monitored gas;

f) replenishing the oxygen content of the process gas flowing from the reaction vessel in response to the monitored oxygen content to contain about 3%–21% by volume oxygen;

g) reintroducing the replenished process gas to the reaction vessel; and h) substantially simultaneously rehydrating and cooling the passivated coal char to form a stable coal char having about 5–10 wt % moisture.

* * * * *